US010547940B1

(12) United States Patent
Liao et al.

(10) Patent No.: US 10,547,940 B1
(45) Date of Patent: Jan. 28, 2020

(54) SOUND COLLECTION EQUIPMENT AND METHOD FOR DETECTING THE OPERATION STATUS OF THE SOUND COLLECTION EQUIPMENT

(71) Applicant: Unlimiter MFA Co., Ltd., Eden Island (SC)

(72) Inventors: Ho-Hsin Liao, Taipei (TW); Kuan-Li Chao, Taipei (TW); Neo Bob Chih-Yung Young, Taipei (TW); Kuo-Ping Yang, Taipei (TW); Jian-Ying Li, Taipei (TW); Po-Jui Wu, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 16/167,597

(22) Filed: Oct. 23, 2018

(51) Int. Cl.
*H04R 3/04* (2006.01)
*H04R 29/00* (2006.01)
*H04R 25/00* (2006.01)

(52) U.S. Cl.
CPC ..... *H04R 3/04* (2013.01); *H04R 29/004* (2013.01); *H04R 25/30* (2013.01); *H04R 25/453* (2013.01); *H04R 25/558* (2013.01); *H04R 2430/01* (2013.01)

(58) Field of Classification Search
CPC .... H04R 25/453; H04R 25/30; H04R 25/558; H04R 2430/01; H04R 29/004; H04R 3/04; H04M 1/72569
See application file for complete search history.

(56) References Cited

U.S. PATENT DOCUMENTS 9,843,872 B2 * 12/2017 Liao ..... H04R 25/453
2004/0196992 A1 * 10/2004 Ryan ..... H04R 1/10 381/312
2004/0202333 A1 * 10/2004 Csermak ..... H04R 25/305 381/60
2005/0058300 A1 * 3/2005 Suzuki ..... H04R 1/406 381/92
2005/0221792 A1 * 10/2005 Mattisson ..... H04M 1/6016 455/355

(Continued)

FOREIGN PATENT DOCUMENTS

CN 201142111 Y * 10/2008
CN 103303404 A * 9/2013

(Continued)

*Primary Examiner* — Davetta W Goins
*Assistant Examiner* — Kuassi A Ganmavo
(74) *Attorney, Agent, or Firm* — Bacon & Thomas, PLLC

(57) ABSTRACT

A sound collection equipment is disclosed. The sound collection equipment includes a speaker, a microphone and a processing unit. The speaker is used for generating a test sound having a first frequency. The microphone is used for receiving an external sound. The processing unit is electronically connected to the microphone and the processing unit. The processing unit is used for determining whether a frequency range of the external sound includes the first frequency and whether the energy of the external sound exceeds a predetermined energy value, and for judging that the sound collection equipment is in a usage state when the frequency range of the external sound includes the first frequency and the energy of the external sound does not exceed the predetermined energy value.

12 Claims, 5 Drawing Sheets

(56) References Cited

U.S. PATENT DOCUMENTS

| | | | | |
|---|---|---|---|---|
| 2006/0251265 | A1* | 11/2006 | Asada | H04R 29/001 381/58 |
| 2009/0012297 | A1* | 1/2009 | Pagoria | C07C 209/84 544/408 |
| 2009/0304195 | A1* | 12/2009 | Fillol | H04R 29/007 381/59 |
| 2015/0086028 | A1* | 3/2015 | Gaiser | H04R 29/001 381/59 |
| 2015/0139430 | A1* | 5/2015 | Miyata | H04R 29/002 381/56 |
| 2017/0034642 | A1* | 2/2017 | Takahashi | G10K 15/00 |
| 2017/0070815 | A1* | 3/2017 | Mitsufuji | H04R 1/406 |

FOREIGN PATENT DOCUMENTS

| | | | |
|---|---|---|---|
| JP | 2004297368 | A * | 10/2004 |
| JP | 2006304244 | A * | 11/2006 |
| JP | 2016116001 | A * | 6/2016 |

* cited by examiner

SOUND COLLECTION EQUIPMENT AND METHOD FOR DETECTING THE OPERATION STATUS OF THE SOUND COLLECTION EQUIPMENT

BACKGROUND OF THE INVENTION

1. Field of the Invention

The present invention relates to a sound collection equipment and a method for detecting an operation status of a sound collection equipment, in particular to a sound collection equipment having both a speaker and a microphone and the method for detecting an operation status of a sound collection equipment.

2. Description of the Related Art

Typically, when a user uses a sound collection equipment such as a hearing aid, the speaker generates annoying high frequency sounds when the microphone is too close to the speaker. This phenomenon, referred to as audio feedback, generally occurs unintentionally when the microphone and the speaker are in close proximity to each other during operation, and the high frequency sound can startle users and generate unpleasant user experiences.

U.S. Pat. No. 9,843,872 discloses a method for detecting an operating state of a sound collection equipment, which can determine whether the sound collection equipment is in the usage state according to the energy of a test sound generated by a speaker and received by a microphone, and which controls a sound amplifier of the sound collection equipment to stop amplifying sound received by the microphone when the sound collection equipment is in the usage state. However, sound received by the microphone may arrive from any environmental source, so the sound received by the microphone may not be the test sound generated by the speaker, such that there may be some error in the determination of the method.

Therefore, it is desirable to provide a method to reduce or eliminate the audio feedback phenomenon in order to resolve the abovementioned issue.

SUMMARY OF THE INVENTION

The objective of the present invention is to provide a sound collection equipment and a method to detect the operating state of the sound collection equipment.

In order to achieve the above objective, the sound collection equipment of the present invention comprises a speaker, a microphone and a processor unit. The speaker is used for generating a test sound having a first frequency. The microphone is used for receiving an external sound. The processor unit is electrically connected to the speaker and the microphone. The processor unit comprises a frequency detection module, a volume detection module and a control module. The frequency detection module is used for determining if a frequency range of the external sound includes the first frequency. The volume detection module is used for determining if the energy of the external sound exceeds a predetermined energy value. The control module is used for judging that the sound collection equipment is in a usage state when the frequency range of the external sound includes the first frequency and the energy of the external sound does not exceed the predetermined energy value.

The method for detecting the operating state of a sound collection equipment of the present invention can be applied to a sound collection equipment which comprises a speaker and a microphone. The method for detecting the operating state of a sound collection equipment of the present invention includes the following steps: generating a test sound having a first frequency via the speaker; receiving an external sound via the microphone; determining if a frequency range of the external sound includes the first frequency; and determining if the energy of the external sound exceeds a predetermined energy value. With the above steps, if the frequency range of the external sound includes the first frequency and the energy of the external sound does not exceed the predetermined energy value, the sound collection equipment is judged to be in a usage state.

BRIEF DESCRIPTION OF THE DRAWINGS

These and other objects and advantages of the present invention will become apparent from the following descriptions of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

The following embodiments are provided in order to further explain the implementations of the present invention. It should be noted that the objects used in the diagrams of the embodiments are provided with proportions, dimensions, deformations, displacements and details as examples and that the present invention is not limited thereto; identical components in the embodiments are the given same component numbers.

Figure 1:
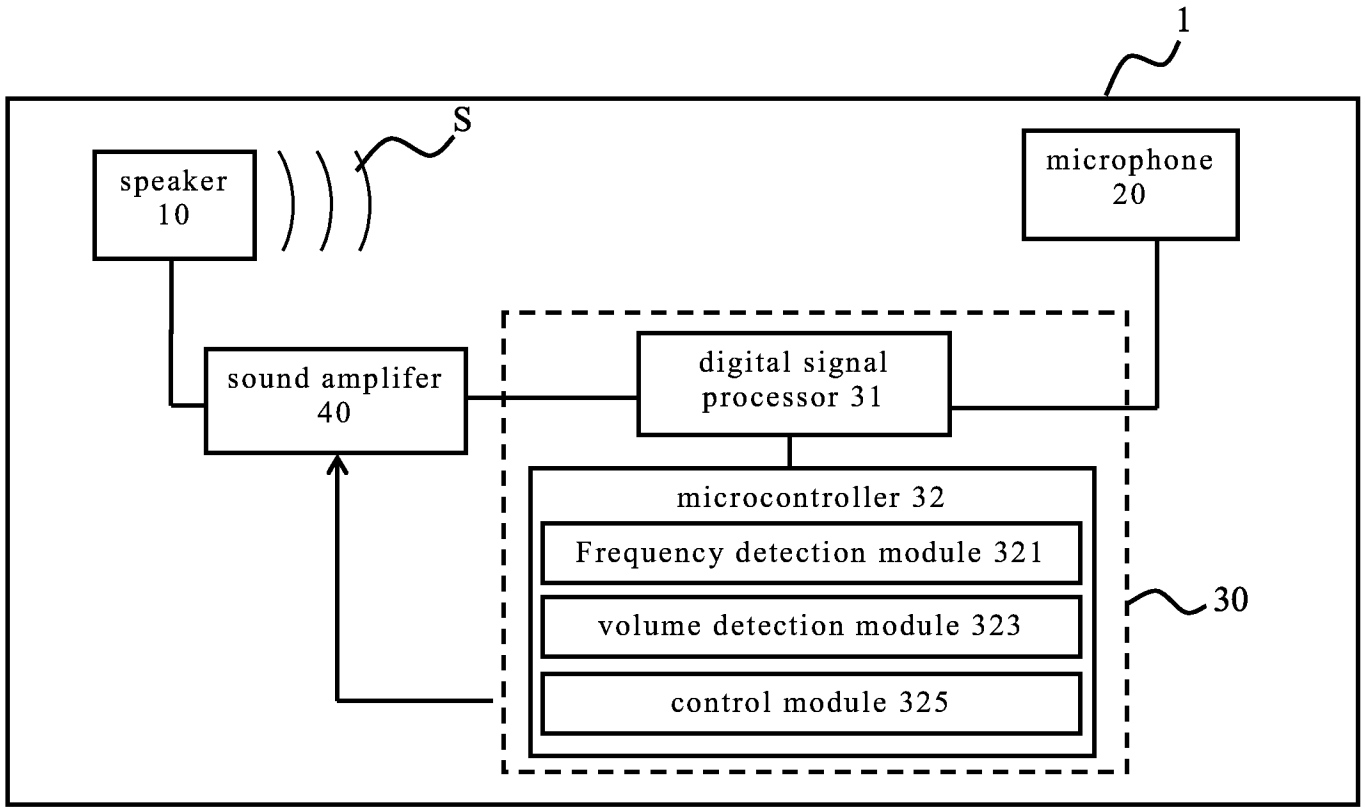
FIG. 1 is a device architecture diagram of the sound collection equipment of the present invention.

First, refer to FIG. 1, which is a device architecture diagram of the sound collection equipment of the present invention As shown in FIG. 1, in an embodiment of the present invention, a sound collection equipment 1 of the present invention comprises a speaker 10, a microphone 20, a processor unit 30 and a sound amplifier 40. In a specific embodiment of the present invention, the sound collection equipment 1 is a hearing aid, but the scope of the present invention is not limited thereto.

In an embodiment of the present invention, the speaker 10 is used for generating a test sound S which has a first frequency, wherein the first frequency is X Hz, where $8{,}000 \leq X \leq 40{,}000$. Preferably, the first frequency of the test sound S is about 20,000 Hz and the loudness of the test sound S does not exceed 20 dB, but the scope of the present invention is not limited thereto.

In an embodiment of the present invention, the microphone 20 is used for receiving an external sound, which may be a test sound S generated by the speaker 10 or be other sounds from the environment. After the microphone 20 receives the external sound, the microphone 20 can generate an input sound signal according to the external sound, and the input sound signal is transmitted to the processor unit 30 for processing.

In an embodiment of the present invention, the processor unit 30 is electrically connected to the speaker 10 and the microphone 20. The processor unit 30 comprises a digital signal processor 31 and a micro controller 32. The digital signal processor 31 is used for processing the input sound signal transmitted from the microphone 20 to generate a corresponding output sound signal. The output sound signal is transmitted to the sound amplifier 40.

In an embodiment of the present invention, the micro controller 32 of the processor unit 30 comprises a frequency detection module 321, a volume detection module 323 and a control module 325. It should be noted that the above respective modules may not only be configured as hardware devices, software programs, firmware, or combinations thereof, but configured by circuit loop or other suitable types. Also, each of the modules can be configured individually or in combination. A preferred embodiment is that all of the modules are configured as software programs, which are installed into a memory (not shown in figures) of the micro controller 32 and implemented by a processor (not shown in figures) of the micro controller 32 to achieve their functions. Additionally, the preferred embodiment of the present invention described herein is only illustrative. To avoid redundancy, not all the possible combinations of changes are documented in detail. However, it shall be understood by those skilled in the art that each of the modules or elements described above may not be necessary. For the implementation of the present invention, the present invention may also contain other detailed, conventional modules or elements. Each module or component is likely to be omitted or modified depending on various demands. Other modules or elements may not necessarily exist between any two modules.

In an embodiment of the present invention, the frequency detection module 321 is used for determining if a frequency range of the external sound received by the microphone 20 includes the first frequency but does not include a second frequency and a third frequency, wherein the second frequency is Y Hz, where $X-1000<Y<X$, and the third frequency is Z Hz, where $X<Z<X+1000$. In other embodiments of the present invention, the frequency detection module 321 can only determine if a frequency range of the external sound received by the microphone 20 includes the first frequency. In other words, it is not necessary to determine if the frequency range of the external sound does not include a second frequency and a third frequency.

In an embodiment of the present invention, the volume detection module 323 is signally connected to the frequency detection module 321. The volume detection module 323 is used for determining if the energy of the external sound received by the microphone 20 exceeds a predetermined energy value.

In an embodiment of the present invention, the control module 325 is signally connected with the frequency detection module 321 and the volume detection module 323. The control module 325 is used for judging that the sound collection equipment 1 is in a usage state when the frequency range of the external sound received by the microphone 20 includes the first frequency but does not include the second frequency and the third frequency and the energy of the external sound does not exceed the predetermined energy value. The usage state of the sound collection equipment 1 and determination of the frequency and volume will be described in detail below, so they are not explained here.

In an embodiment of the present invention, the sound amplifier 40 is electrically connected to the processor unit 30. The sound amplifier 40 is used for amplifying an output sound signal generated by the digital signal processor 31 of the processor unit 30 and transferring the amplified output sound signal to the speaker 10 such that the speaker 10 plays sounds according to the amplified output sound signal.

Figure 2:
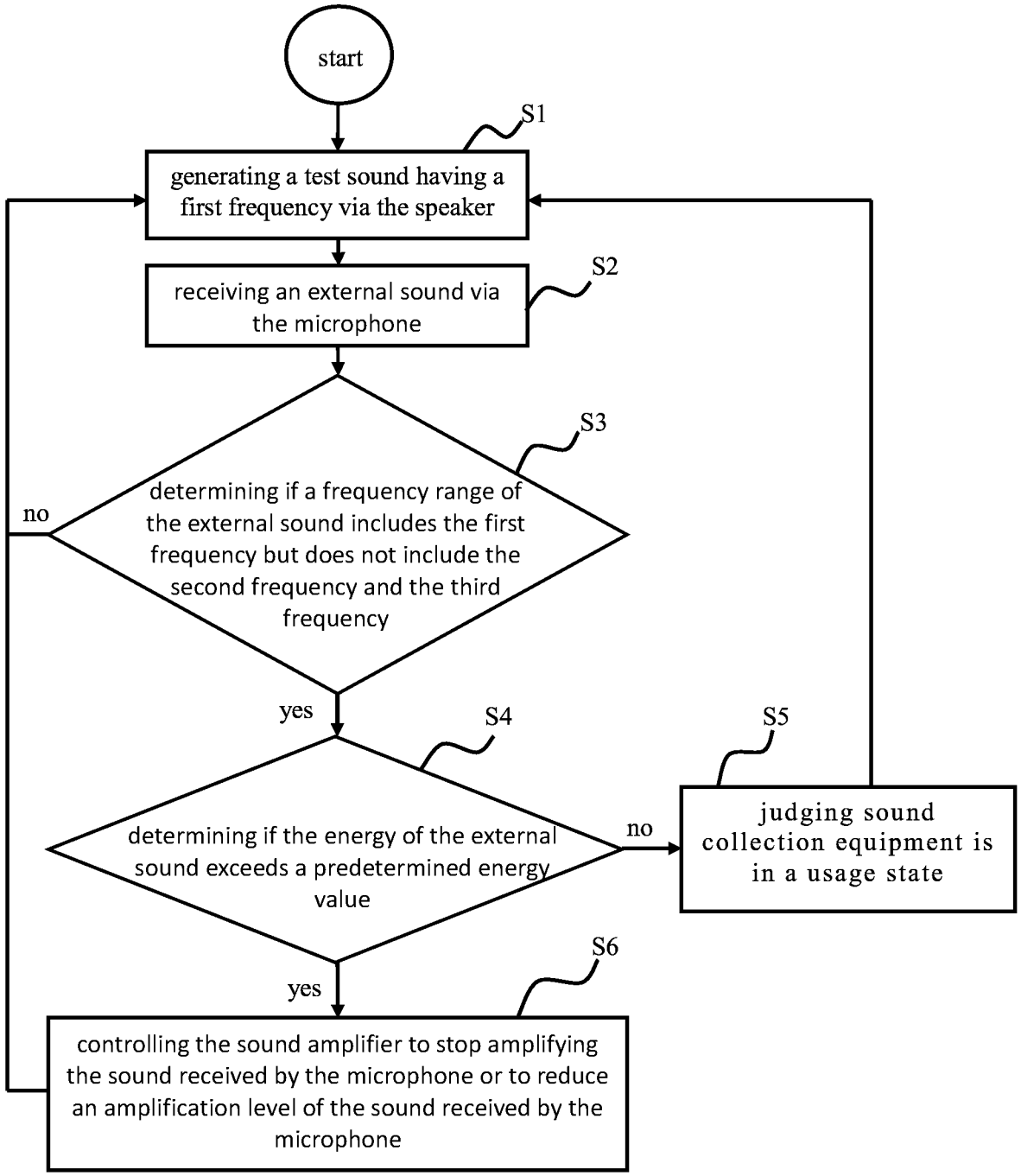
FIG. 2 is a step flowchart of a method for detecting an operating state of a sound collection equipment of the present invention.

Next, refer to FIG. 1 to FIG. 7. FIG. 2 is a step flowchart of a method for detecting an operating state of a sound collection device according to the present invention. The steps shown in FIG. 2 are further presented in detail in FIG. 1 and in FIG. 3 to FIG. 7. It should be noted that the following implementation is based on the sound collection equipment 1 described previously to illustrate the method for detecting an operating state of a sound collection equipment according to the present invention. However, the scope of the method for detecting an operating state of a sound collection equipment according to the present invention is not limited to the sound collection equipment 1 described previously.

First, executing step S1: generating a test sound having a first frequency via the speaker.

Figure 3:
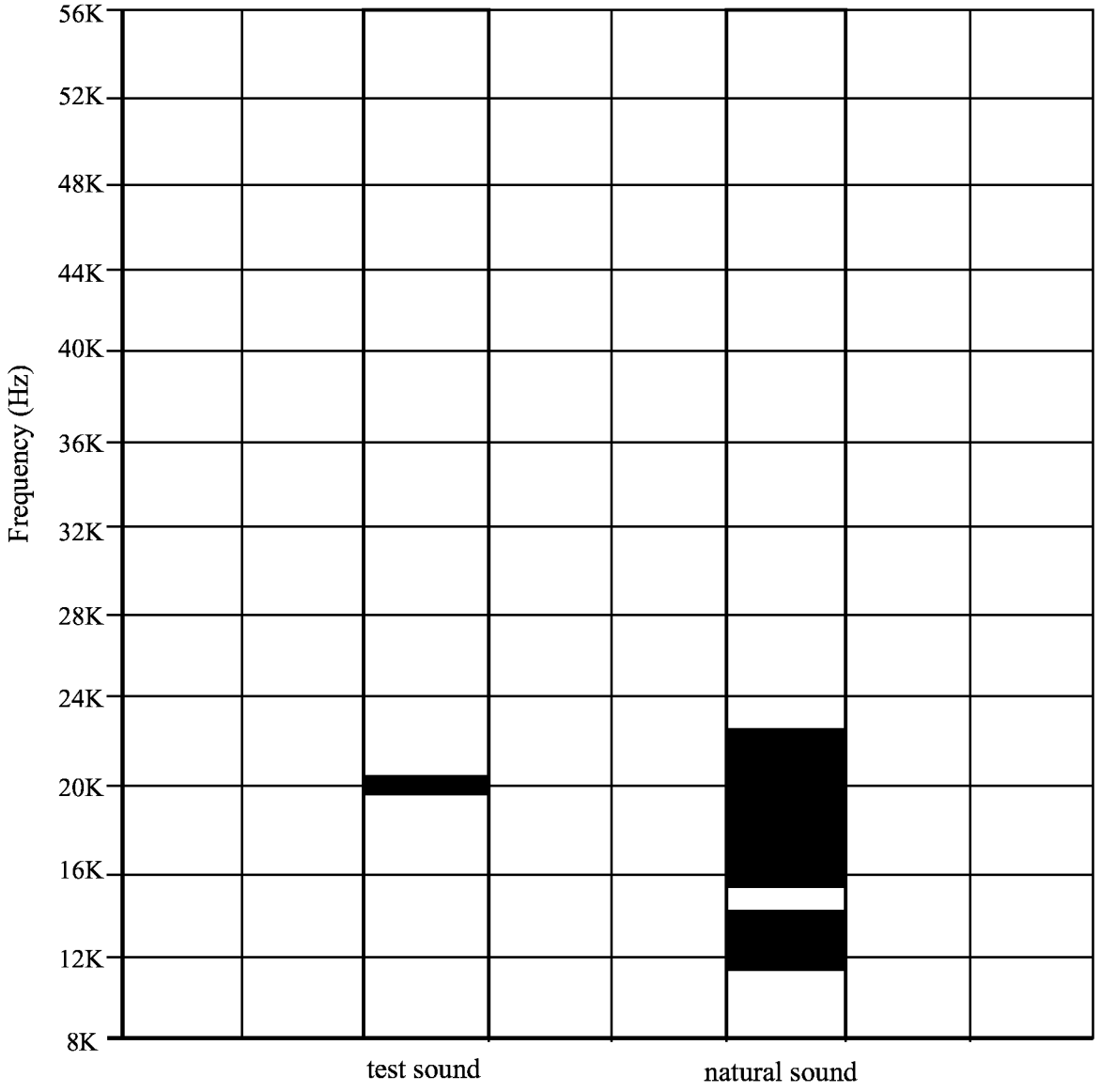
FIG. 3 shows the distribution of the frequency range of a test sound and an environmental sound.

The method for detecting an operating state of a sound collection equipment of the present invention is applicable to a sound collection equipment 1, such that as shown in FIG. 1, and the sound collection equipment 1 includes a speaker 10 and a microphone 20. In the first step of the method, the micro controller 32 of the processor unit 30 controls the speaker 10 to generate a test sound S having a first frequency (i.e., the micro controller 32 generates and transmits an output sound signal to the speaker 10). In a specific embodiment of the present invention, the first frequency is X Hz, where $8000 \leq X \leq 40{,}000$. The frequency range of the test sound S approximates a single frequency, which is preferably about 20,000 Hz, as shown in FIG. 3 (i.e., X is substantially 20,000).

Executing step S2: receiving an external sound via the microphone.

The microphone 20 of the sound collection equipment 1 can receive an external sound which may be a test sound S generated by the speaker 10 or other sounds from the environment.

Executing step S3: determining if a frequency range of the external sound includes the first frequency but does not include the second frequency and the third frequency.

Because the microphone 20 can receive any sounds from the environment, in a specific embodiment of the present invention, the frequency detection module 321 of the processor unit 30 not only determines if the frequency range of the external sound includes the first frequency but also further determines if the frequency range of the external sound does not include a second frequency and a third frequency to confirm that the external sound received by the microphone 20 is the test sound S to avoid misjudgment. The values of the second frequency and the third frequency are close to that of the first frequency, wherein the second frequency is Y Hz, where $X-1000<Y<X$, and the third frequency is Z Hz, where $X<Z<X+1000$. For example, assume that the first frequency is 20,000 Hz as described above; the second frequency is 19,001-19,999 Hz and the third frequency is 20,001-20,999 Hz.

As shown in FIG. 3, the frequency range of sound generated from the environment is broad, which means that the frequency range of the environmental sound covers a wide range. However, the frequency range of the test sound S is approximate to a single frequency, so the control module 325 can judge that the external sound is the test sound S when the frequency detection module 321 further determines that the frequency range of the external sound does not include the second frequency and the third frequency. If the frequency range of the external sound does not include the first frequency or includes the second frequency and the third frequency, step S4 is not executed.

Executing step S4: determining if the energy of the external sound exceeds a predetermined energy value.

In an embodiment of the present invention, after step S3 is executed, if the frequency range of the external sound received by the microphone 20 includes the first frequency but does not include the second frequency and the third frequency, i.e., it is determined that the external sound is the test sound S, the volume detection module 323 will determine if the energy of the external sound exceeds a predetermined energy value (for example: 10 dB).

Figure 4:
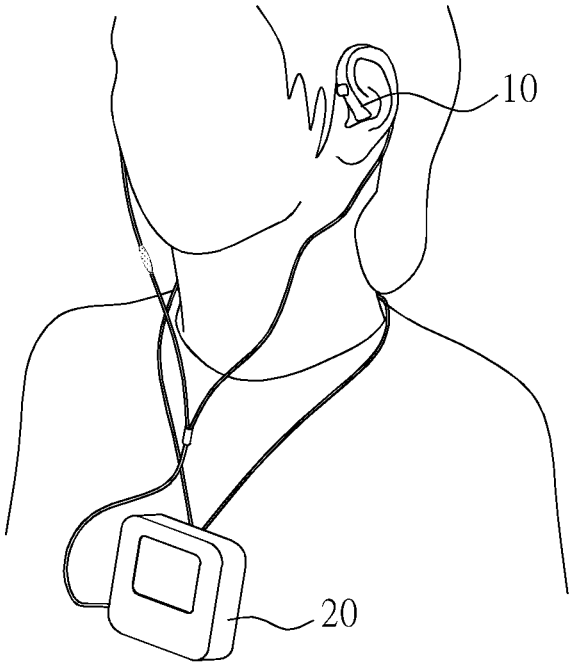
FIG. 4 is a schematic diagram of the first embodiment indicating that the electronic device is in a usage state.
Figure 5:
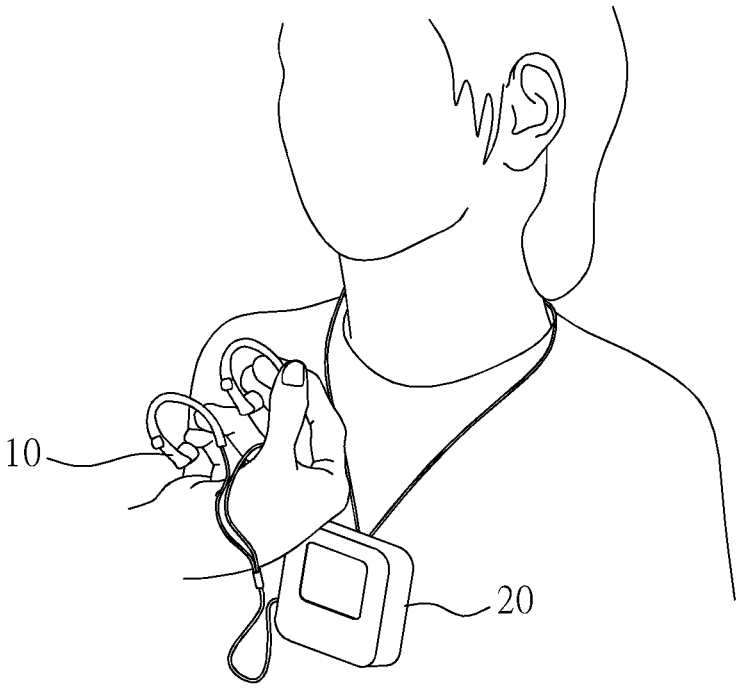
FIG. 5 is a schematic diagram of the first embodiment indicating that the electronic device is not in a usage state.

As shown in FIG. 1 and FIG. 4, in an embodiment of the present invention, when a user uses the sound collection equipment 1, i.e., the sound collection equipment 1 is in a usage state, the speaker 10 of the sound collection equipment 1 is placed near the ears of the user, and the microphone 20 hangs on the user's chest. Accordingly, the distance between the speaker 10 and the microphone 20 is equal to or greater than a certain distance. As shown in FIG. 5, when the user does not use the sound collection equipment 1 and wants to store the sound collection equipment 1, the microphone 20 frequently is placed at less than the certain distance from the speaker 10 in order to reduce the required storage space. Therefore, the sound collection equipment 1 being in the usage state refers to the speaker 10 being at a predetermined distance (for example: 60 cm or more) from the microphone 20. Because the sound collection equipment 1 is in the usage state, the distance between the speaker 10 and microphone 20 is equal to or greater than the predetermined distance. Thus, the energy of the test sound S received by the microphone 20 does not exceed the predetermined energy value. On the other hand, when the sound collection equipment 1 is not in the usage state, the distance between the speaker 10 and the microphone 20 is shorter than the predetermined distance. Thus, the energy of the test sound S received by the microphone 20 exceeds the predetermined energy value. As a result, if the external sound received by microphone 20 is definitely the test sound S and the energy of the external sound does not exceed the predetermined energy value, it is judged that the sound collection equipment 1 is in a usage state (step S5). In contrast, if the external sound is definitely the test sound S and the energy of the external sound exceeds the predetermined energy value, it is judged that the sound collection equipment 1 is not in the usage state.

Figure 6:
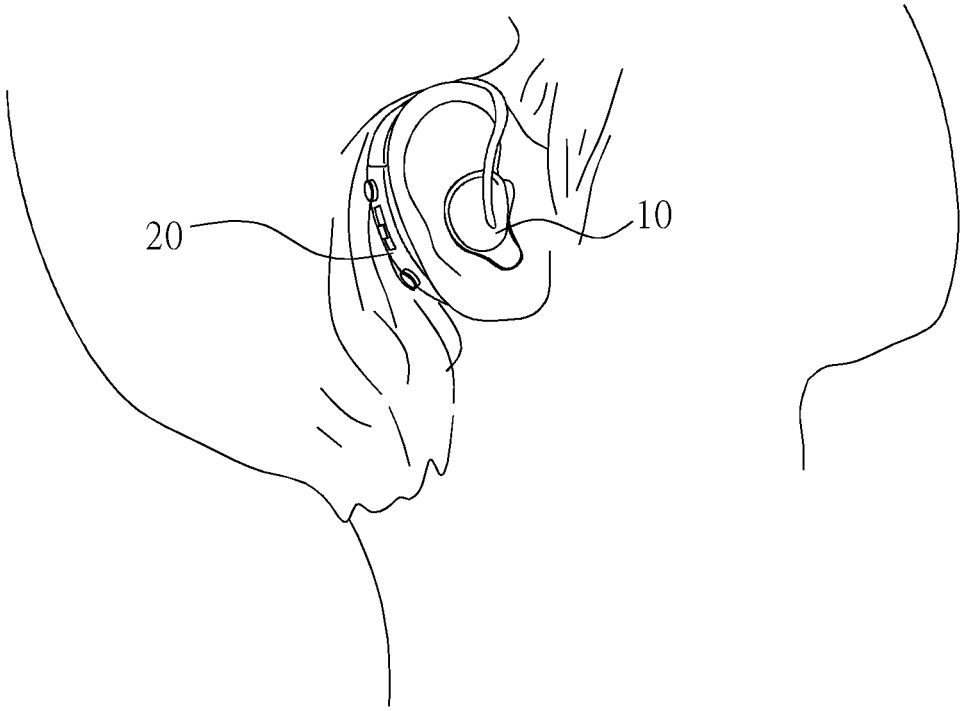
FIG. 6 is a schematic diagram of the second embodiment indicating that the electronic device is in a usage state.
Figure 7:
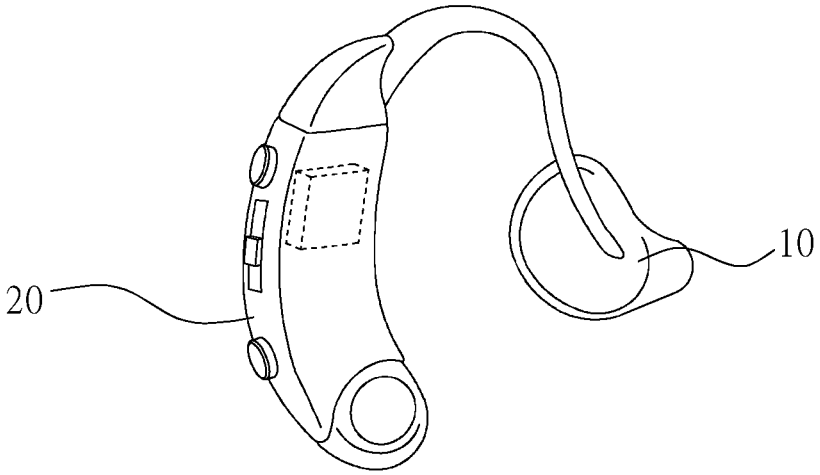
FIG. 7 is a schematic diagram of the second embodiment indicating that the electronic device is not in a usage state.

As shown in FIG. 1 and FIG. 6, in another embodiment of the present invention, when a user uses the sound collection equipment 1, i.e., the sound collection equipment 1 is in the usage state, the speaker 10 of the sound collection equipment 1 is placed near the ears and the microphone 20 is placed at the back of the ear. The speaker 10 and the microphone 20 are blocked by the auricle. On the other hand, as shown in FIG. 7, once the user removes the sound collection equipment 1 from the ear, the speaker 10 and the microphone 20 are not blocked by any objects. Accordingly, in this embodiment, the sound collection equipment 1 being in the usage state refers to an object being located between the speaker and the microphone of the sound collection equipment 1. When the sound collection equipment 1 is in the usage state, the speaker 10 and the microphone 20 of the sound collection equipment 1 are blocked by an object, and the energy value of the test sound S received by the microphone 20 does not exceed a predetermined energy value. On the other hand, when the sound collection equipment 1 is not in the usage state, the speaker 10 and the microphone 20 of the sound collection equipment 1 are not blocked by an object, and the energy value of the test sound S received by the microphone 20 exceeds a predetermined energy value. As a result, if the external sound received by the microphone 20 is definitely the test sound S and the energy of the external sound does not exceed the predetermined energy value, it is judged that the sound collection equipment 1 is in a usage state (step S5). In contrast, if the external sound is definitely the test sound S and the energy of the external sound exceeds the predetermined energy value, it is judged that the sound collection equipment 1 is not in the usage state.

Execute step S6: controlling the sound amplifier to stop amplifying the sound received by the microphone or to reduce an amplification level of the sound received by the microphone.

Once it is determined that the sound collection equipment 1 is not in the usage state, i.e., the frequency range of the external sound includes the first frequency but does not include the second frequency and the third frequency and the energy of the external sound exceeds the predetermined energy value, the control module 325 of the micro controller 32 of the processor unit 30 controls the sound amplifier 40 to stop amplifying the sound received by the microphone 20 or to reduce an amplification level of the sound received by the microphone 20 in order to prevent the audio feedback resulting from the speaker 10 and the microphone 20 being placed too close to each other.

According to the above description, the method for detecting an operating state of a sound collection equipment of the present invention is to judge if the sound collection equipment 1 is in the usage state by determining the energy level of the test sound S and to stop amplifying the sound received by the microphone or to reduce an amplification level of the sound received by the microphone so as to prevent audio feedback from occurring when the sound collection equipment 1 is not in the usage state. Furthermore, the method for detecting an operating state of a sound collection equipment of the present invention is to make sure that the sound received by the microphone 20 is definitely the test sound S from the speaker 10 in order to prevent misjudgment of the source of the sound.

While the present invention has been particularly shown and described with reference to a preferred embodiment, it will be understood by those skilled in the art that various changes and modifications can be made to the described embodiments. It is intended to include all such variations, modifications and equivalents which fall within the scope of the invention, as defined in the accompanying claims. It is to be understood that many other possible modifications and variations can be made without departing from the spirit and scope of the invention as hereinafter claimed.

What is claimed is:

1. A sound collection equipment, comprising: a speaker, used for generating a test sound having a first frequency, wherein the first frequency is X Hz; a microphone, used for receiving an external sound; and a processor unit, electrically connected to the speaker and the microphone, comprising: a frequency detection module, used for determining if a frequency range of the external sound include the first frequency and a second frequency band which is Y Hz, where X−1000<Y<X; a volume detection module, used for determining if the energy of the external sound exceeds a predetermined energy value; and control module, used for judging that the sound collection equipment is in a usage state when the frequency range of the external sound includes the first frequency but does not include the second frequency band and the energy of the external sound does not exceed the predetermined energy value.

2. The sound collection equipment of claim 1, wherein the frequency detection module is further used for determining if the frequency range of the external sound includes a third frequency which is Z Hz, where X<Z<X+1000; the control module is used for judging that the sound collection equipment is in a usage state when the frequency range of the external sound includes the first frequency but does not include the second frequency band and the third frequency and the energy of the external sound does not exceed the predetermined energy value.

3. The sound collection equipment of claim 1, wherein 8000<X<40,000.

4. The sound collection equipment of claim 1, further comprising a sound amplifier, the sound amplifier being electrically connected to the processor unit; when the frequency range of the external sound includes the first frequency and the energy of the external sound exceeds the predetermined energy value, the control module is further used for controlling the sound amplifier to stop amplifying sounds received by the microphone or to reduce an amplification level of the sounds received by the microphone.

5. The sound collection equipment of claim 1, wherein the sound collection equipment being in the usage state refers to the speaker being at or exceeding a predetermined distance from the microphone.

6. The sound collection equipment of claim 1, wherein the sound collection equipment being in the usage state refers to an object being located between the speaker and the microphone.

7. The method, for detecting an operating state of a sound collection equipment, applicable to a sound collection equipment, which comprises a speaker and a microphone, the method comprising the following steps: generating a test sound having a first frequency via the speaker, wherein the first frequency is X Hz; receiving an external sound via the microphone; determining if the frequency range of the external sound includes the first frequency and a second frequency band which is Y Hz, where X−1000<Y<X; determining if the energy of the external sound exceeds a predetermined energy value; whereby with the above steps, if the frequency range of the external sound includes the first frequency but does not include the second frequency band and the energy of the external sound does not exceed the predetermined energy value, the sound collection equipment is judged to be in a usage state.

8. The method of claim 7, further comprising the following step: determining if the frequency range of the external sound includes a third frequency which is Z Hz, where X<Z<X+1000; whereby with the above steps, if the frequency range of the external sound includes the first frequency but does not include the second frequency band and the third frequency and the energy of the external sound does not exceed the predetermined energy value, the sound collection equipment is judged to be in a usage state.

9. The method of claim 7, wherein 8000<X<40,000.

10. The method of claim 7, wherein the sound collection equipment further comprises a sound amplifier; when the frequency range of the external sound includes the first frequency and the energy of the external sound exceeds the predetermined energy value, the method further comprises the following step: controlling the sound amplifier to stop amplifying the sound received by the microphone or to reduce an amplification level of the sound received by the microphone.

11. The method of claim 7, wherein the sound collection equipment being in the usage state refers to the speaker being at or exceeding a predetermined distance from the microphone.

12. The method of claim 7, wherein the sound collection equipment being in the usage state refers to an object being located between the speaker and the microphone.

* * * * *